United States Patent [19]

Deetz

[11] 4,053,043

[45] Oct. 11, 1977

[54] MEANS AND METHOD FOR ENHANCING RIBBON LIFT

[75] Inventor: David R. Deetz, Dallas, Tex.

[73] Assignee: Xerox Corporation, Stamford, Conn.

[21] Appl. No.: 644,391

[22] Filed: Dec. 29, 1975

[51] Int. Cl.[2] ..... B41J 35/20; B41J 1/24

[52] U.S. Cl. ..... 197/53; 197/151; 197/154

[58] Field of Search ..... 197/18, 49, 53, 54, 197/151, 154–159; 101/336

[56] References Cited

U.S. PATENT DOCUMENTS

| | | | |
|---|---|---|---|
| 1,889,315 | 11/1932 | Henderson | 197/159 X |
| 3,554,349 | 1/1971 | Hebert | 197/154 |
| 3,568,826 | 3/1971 | Mychalowych et al. | 199/59 |
| 3,586,953 | 6/1971 | Markkanen et al. | 318/685 |
| 3,707,214 | 12/1972 | Ponzano | 197/53 |
| 3,872,960 | 3/1975 | Gabor | 197/53 |
| 3,904,015 | 9/1975 | Boyden et al. | 197/151 |

*Primary Examiner*—Edgar S. Burr
*Assistant Examiner*—Paul T. Sewell

[57] ABSTRACT

To enable an impact printer, employing a daisy wheel print element and a ribbon which is raised to an up or print position from a down or character viewing position, to print without loss of portions of the characters because of incomplete ribbon lift caused by contact between the ribbon and the print wheel, provision is made for enhancement of ribbon lift by controlling the direction of print wheel rotation during ribbon lift.

5 Claims, 7 Drawing Figures

MEANS AND METHOD FOR ENHANCING RIBBON LIFT

BACKGROUND OF THE INVENTION

This invention relates in general to impact printers with wheel-type print elements and more particularly to the means and methods for enhancing the ribbon lift function during operation of the printer.

The Diablo Corporation, a subsidiary of the present assignee, is marketing a serial printer under the tradename of Diablo Hytype I which employs a movable carriage with a daisy-type print wheel, print hammer and ribbon cartridge mounted thereon. A printer of this type is disclosed in a U.S. patent application filed Sept. 4, 1973, in the name of Andrew Gabor, Ser. No. 394,072, entitled "High Speed Printer with Intermittent Print Wheel and Carriage Movement", being a continuation of an application filed Feb. 25, 1972, Ser. No. 229,314, both now abandoned, the disclosure of which is incorporated by reference into this specification.

The Diablo Hytype I printer is enjoying commercial success as a serial printer in such applications as communication terminals, computer output devices, etc. However, in certain type applications, such as automatic text-editing typewriter applications in the office environment, additional features and capabilities are desired, e.g., higher print quality. In the text-editing or office-typing environment, the demands for high print quality cause the print wheel to be subjected to about ten times greater force due to about five times greater hammer energy compared to a Hytype I printer operating as a computer output terminal, for example.

A modified model of the Hytype I printer is employed as the printing mechanism of the commercially available Xerox 800 Electronic Typing System for automatic text-editing typewriter applications in the office environment. To provide the high print quality needed, the integrally molded thermoplastic print wheel of the Hytype I printer was replaced by a composite print wheel, such as that disclosed in a U.S. patent application, filed Sept. 25, 1974, in the name of Gordon Sohl et al., Ser. No. 509,193. In addition, a different print hammer assembly was incorporated therein which provided greater hammer energy. A card guide was added to the carriage to provide assistance in the operation of inserting and aligning paper in the automatic text-editing typewriter. The Diablo Hytype I ribbon cartridge containing a fabric ribbon was replaced by a ribbon cartridge containing a matrix-type plastic ribbon from which a higher quality of printed material may be obtained.

In the environment provided by the modified printer, when the matrix-type plastic ribbon was impacted between the character slug of the print wheel and the paper, the plastic ribbon tended to curl or become cup-shaped around a longitudinal centerline of the ribbon. The upper and lower edges of the plastic ribbon curled toward the print wheel. The spacings between the paper, ribbon and composite print wheel are extremely close because of the modification (addition of a card guide and the thicker character slugs of the new composite print wheel) to the printer and on occasions the curled edge or edges of the plastic ribbon would make contact with the print wheel while the print wheel was rotating to the next print position. When this type of contact occurred, the plastic ribbon could, on occasions, be prevented from lifting or completely lifting to its print position, from its lower rest position, resulting in the loss of that particular character or the cropping of the upper portions of the character or characters.

With these prior art problems in mind, it is a primary object of the present invention to provide a means and method for enhancing the ribbon lift function and thereby reduce printing malfunctions.

Another object of this invention is to provide a means and method for enhancing the ribbon lift function of a print wheel impact printer along the presently described vane.

Other objects and advantages will be evident from the specification and claims when read in conjunction with the accompanying drawing illustrative of the invention.

SUMMARY OF THE INVENTION

In accordance with the principles illustrative of this invention, the foregoing objects and others of the present invention, to enable an impact printer employing a daisy wheel print element and a ribbon, which is raised to an up or print position from a down or character viewing position, to print without loss of portions or the printed characters because of incomplete ribbon lift, are accomplished by the provision of enhancement of the ribbon lift by the controlling of the direction of print wheel rotation during the lifting of the ribbon. A cross-coupled latch means in cooperation with an OR gate assures that when the ribbon is lifted or raised to the up or print position, the print wheel will be rotated to the next character to be printed in a direction which, if contact is made between the ribbon and the print wheel, movement of the print wheel will enhance the lifting of the ribbon. After the ribbon is in the up or print position, the print wheel will be allowed to be rotated in a direction which provides the shortest path of rotation to the next character to be printed.

BRIEF DESCRIPTION OF THE DRAWING

Other advantages and features of the present invention may become more apparent from reading the following detailed description in connection with the drawing forming a part thereof in which.

DESCRIPTION OF THE PREFERRED EMBODIMENT

Figure 1:
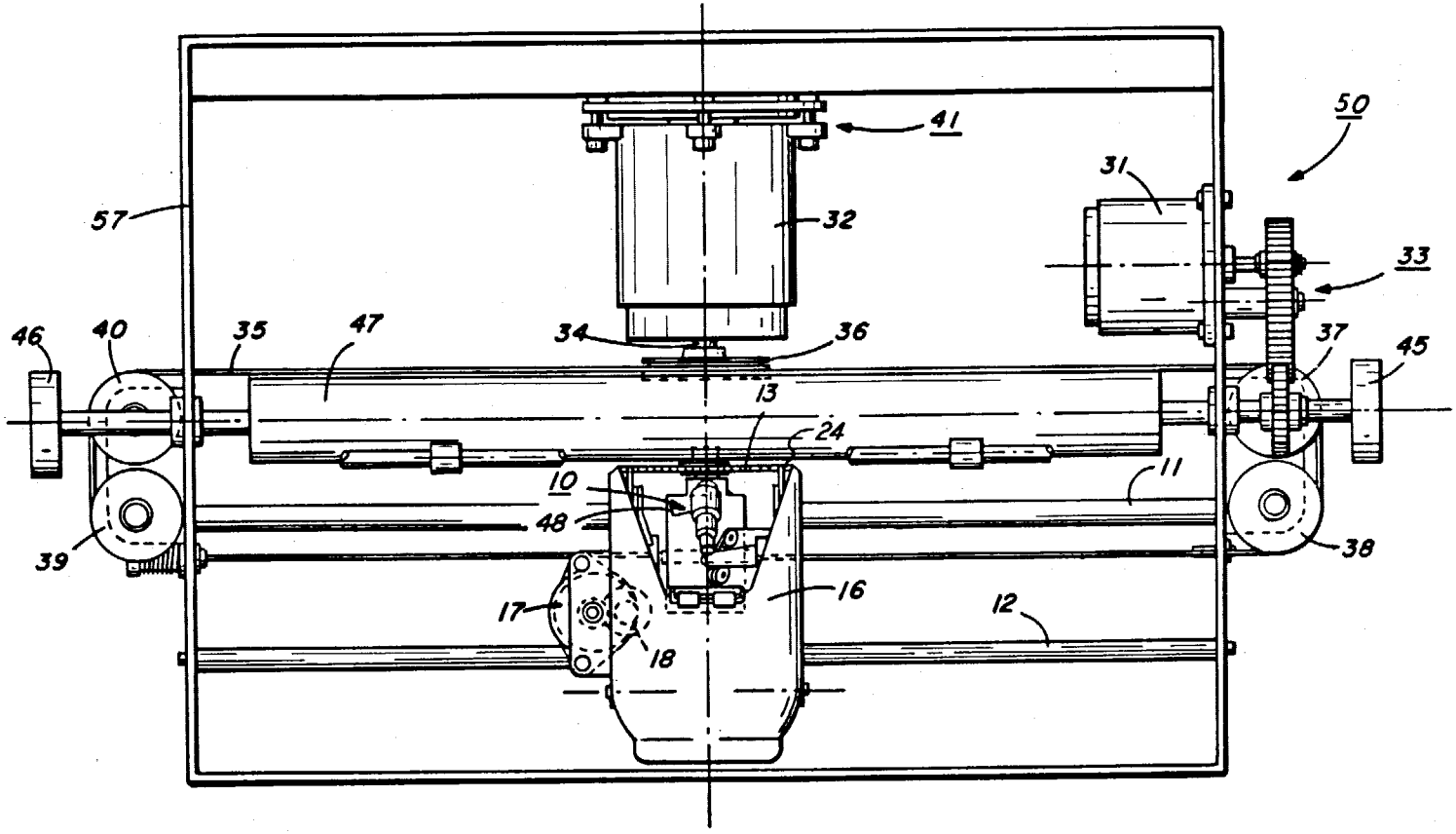
FIG. 1 is a top plan view of a printer embodying the present invention as viewed by the operator.

Referring now to the drawing and more particularly to FIG. 1, an overall view of the printer embodying the present invention is illustrated. Mounted on a base frame 57 is a platen 47 with knobs 45 and 46 for rolling the platen 47 and the paper record medium (not shown) wrapped thereon. A carriage 10 is mounted for linear movement on the carriage mounting rails 11 and 12 bridged between opposed sidewalls of the base frame 57 of the printer 50. Carriage 10 includes a rotary print wheel 13 on which are a number of type elements or character slugs, a hammer-type impact printing mechanism 48 for striking a selected type element, a ribbon cartridge 16 having an inked ribbon 24 interposed between the paper on the platen 47 and the type element on the print wheel 13 located at the print position or station and a ribbon advance motor 17 as best shown in FIG. 2.

Furthermore, there are a stepping motor 31 and a servomotor 32 mounted on the base frame 57. The stepping motor 31 is coupled to the platen 47 by a gear train 33 so that the platen 47 is indexed when the motor 31 is activated to incrementally advance the paper through the printer 40. The servomotor 32, on the other hand, has one end of its drive shaft 34 coupled to the carriage 10 by a cable 35, which is trained around a series of pulleys 36–40, and the other end of its drive shaft 34 coupled to a shaft encoder 41. Thus, the carriage 10 is moved to translate the printing mechanism 48 lengthwise of the platen 47 when the servomotor 32 is actuated, while the encoder 41 supplies a signal which is representative of the actual position of the carriage 10 at any given time.

Figure 2:
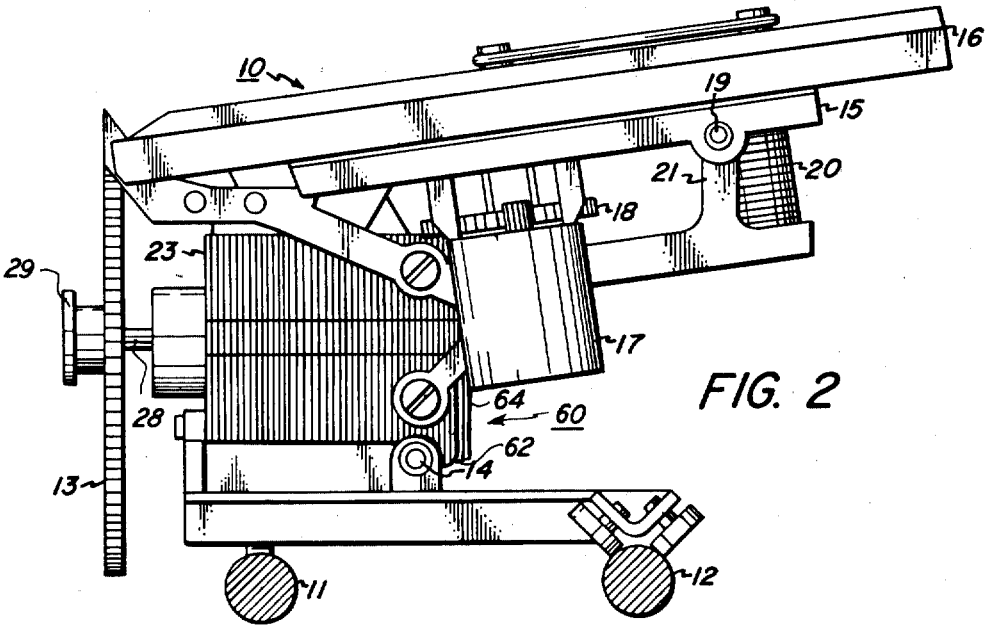
FIG. 2 is a side plan view of the carriage of the printer of FIG. 1.

With reference to FIGS. 1 and 2 and the printer carriage 10 mounted for linear movement on the mounting rails 11 and 12, as typing of the printed characters occurs, the carriage 10 stops each time a character is to be printed. Also, while the carriage 10 is moving from one location to the next location along rails 11 and 12 by movement of cable 35, the print wheel 13 is rotated such that the next character to be printed will be in position at the print position or station when the carriage 10 stops and the printing mechanism 48 is fired. As seen in FIG. 2, the upper portion of carriage 10 is pivotable clockwise about shaft 14 with respect to the lower portion of carriage 10. This pivoting motion is necessary in order to bring the print wheel 13 up into a position such that the print wheel may be exchanged for a different print wheel.

The ribbon cartridge mounting plate 15 provides the mounting structure for the ribbon cartridge 16, the ribbon advance motor 17 and the ribbon advance gearing 18. The ribbon cartridge mounting plate 15 is pivotable clockwise, in FIG. 2, about shaft 19. This pivoting motion is necessary to raise the ribbon from the down position, which is the position that allows the printed material to be viewed by the operator, to the up position at the print station when printing is to occur. The force to pivot the ribbon cartridge mounting plate 15 is a magnetic force supplied by electromagnet coils 20. When coils 20 are energized, that portion of the ribbon cartridge mounting plate 15 above coils 20 is drawn down toward the coils thereby raising that portion of the ribbon cartridge 16 which is nearest the print wheel 13 to the print position.

Still referring to FIGS. 1 and 2, carriage 10 also includes a motor 23 having a shaft 28. Mounted on one end of the shaft is the rotary print wheel 13. Wheel 13 includes a central cap portion 29 constructed of rubber with a stiffening ring which allows the wheel 13 to be easily removed from shaft 28 and, for example, replaced with another wheel with, for example, a different font of characters. The other end of shaft 28 has mounted thereon a transducer 60 which provides position signals related to the rotary positions of the shaft and therefore of the print wheel 13. Transducer 60 includes a fixed disk 62 adjacent a disk 64 mounted for rotation with shaft 28. Electrical interaction between these two disks 62 and 64 produces the position signals which are used in a servo system for controlling the print wheel 13. In general, disks 62 and 64 include a plurality of substantially parallel conductors on their surfaces with one of the disks being supplied a high-frequency signal from an oscillator. This signal is coupled to the other disk to provide position signals from which the position and velocity of the shaft 28 and its printing wheel 13 can be ascertained. Consequently, when motor 23 is activated with the necessary signal, the print wheel 13 is rotated as necessary to bring any selected one of its character slugs 2 into alignment with the hammer printing mechanism 48 for printing of the selected character. Additionally, the transducer 60 supplies a continuously updated signal which is representative of the actual position of the print wheel 13. Details of such transducers and associated servo systems are disclosed and claimed in U.S. Pat. No. 3,839,665 entitled "Apparatus for the Measurement of Relative Velocity Between Two Relatively Movable Members".

Figure 3:
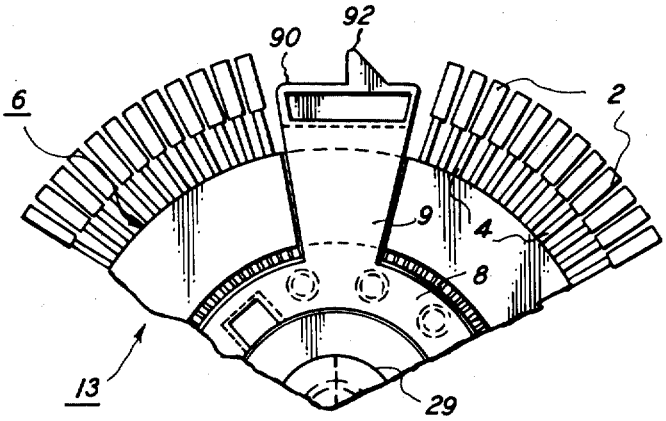
FIG. 3 is a fragmentary plan view of the print wheel of the printer of FIG. 1.

As shown in greater detail in FIG. 3, the print wheel 13 is a composite structure being made up of several components, the most prominent of which are the spokes or beams 4 with the character slugs 2 molded onto the ends thereof and the hub 8 riveted to the center of the wheel with its flag 9 extending outwardly amidst the spokes 4. Other components include the damper 6 mounted over the beams to alter their deflection properties and a central cap portion 29, for handling the print wheel 13, which resides at the core of the print wheel atop the hub 8.

The flag 9 is integral with hub 8, being fabricated with the hub as a unit in an injection molding process. The flag 9 is a truncated pie-shaped element whose width increases with radii, unlike spokes 4 which have a fixed width over their length. The outer end of the flag 9 includes a straight edge 90, which underlines the line of characters being printed. When the ribbon 24 is in the down position, which allows the operator to view the printed material, the top edge of the ribbon is approximately even with straight edge 90. At the very end of the flag 9 is the pointer 92, which is a vertical reference mark to help the operator to visually align the eye to the printing position. Details of the composite print wheel are disclosed and claimed in a copending application Ser. No. 509,193, filed Sept. 25, 1974, entitled "Composite Print Wheel" by Gordon Sohl et al. and assigned to the present assignee.

Figure 4:
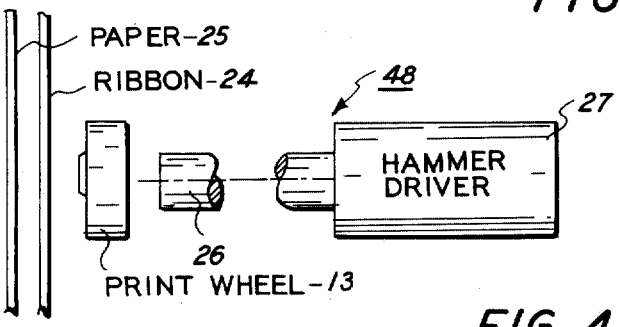
FIG. 4 is a simplified schematic view of the impact printing mechanism of the printer of FIG. 1.

As shown in greater detail in FIG. 4, the various relationships of the elements directly involved with the impact printing of the characters are shown. There is a hammer-type impact printing mechanism 48 to provide the impact force necessary for printing on a paper recording medium 25 which is positioned on platen 47. To that end, the printing mechanism 48 comprises a hammer driver 27 for propelling a hammer slug or armature 26 forwardly, thereby urging a character slug 2 on a prepositioned print wheel 13 into engagement with a ribbon 24 (raised to the up position) which, in turn, strikes the paper 25 to print a replica of the character on the character slug.

The printer cannot function in and of itself but responds to logical inputs or instructions from an external control source. The operation of the printer together with the interface requirements thereof are described in substantial detail in copending and commonly assigned U.S. patent applications of H. Wallace Swanstrom et al., which were filed Jan. 2, 1974, under Ser. No. 429,479 and Oct. 15, 1975, under Ser. No. 622,780 (both of which are hereby incorporated by reference) and will not be repeated herein. Nevertheless, a brief review of the printer interface may be helpful.

Figure 5:
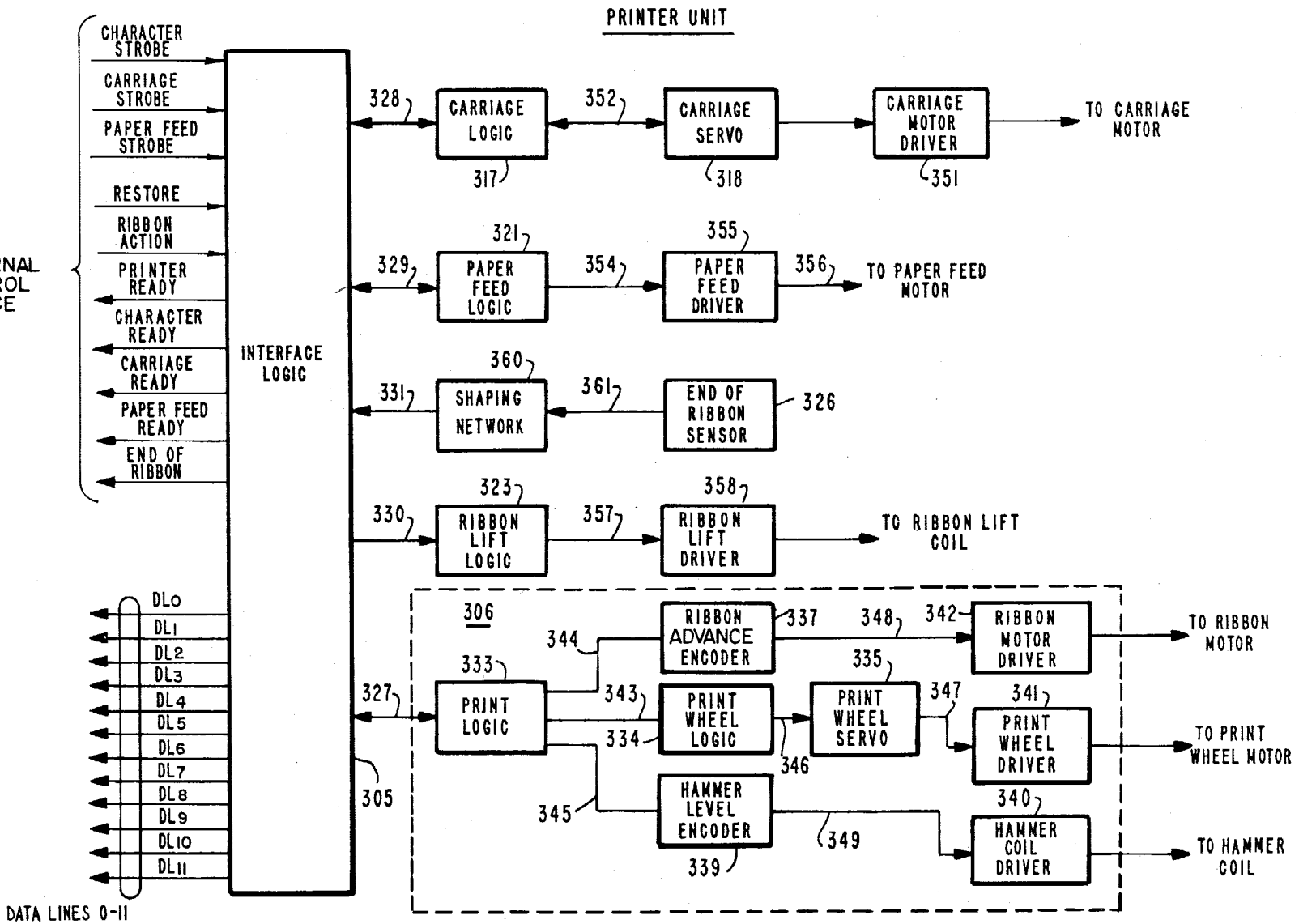
FIG. 5 is a block diagram schematically illustrating the logic details of the printer of FIG. 1.

With reference to FIG. 5, there is shown a block diagram schematically illustrating the logical details of the printer unit of FIG. 1. The printer unit as illustrated in FIG. 5 comprises interface logic for the printer unit indicated by the block 305, print logic circuitry indicated by the dashed block 306, carriage logic means 317, carriage servo system means 318, paper-feed logic means 321, ribbon lift logic means 323 and end of ribbon sensor means 326. The printer unit interface logic indicated by the block 305 includes appropriate logic and gating circuitry for raising inputs and outputs applied thereto the appropriate levels and for thereafter distributing such input signals in an appropriate manner corresponding to the nature of such input signals to either the print logic circuitry indicated by the dashed block 306, the carriage logic means 317, the paper feed logic means 321 or the ribbon lift logic means 323. In addition, as described in U.S. patent application Ser. No. 429,479, the interface logic indicated by the block 305 may include means responsive to system clock inputs for gating information in a bidirectional manner therethrough in appropriately timed sequences.

The interface logic indicated by the block 305 is connected along the left-hand portion thereof to a plurality of input and output connectors. More particularly, data lines $DL_0$–$DL_{11}$ receive either 12-bit print information, 12-bit carriage displacement information or 12-bit paper indexing information from the external control source. In addition, several action or operational strobes are received. The 12 bits of data tell the printer what to do; the strobes tell the printer when to do the instructions. Once having received this external data, the printer electronics take over and perform the necessary steps to accomplish the instructions.

The nature of the 12 bits of data supplied to the printer unit through lines $DL_0$–$DL_{11}$ will vary depending upon which of three printer unit motions are being defined. Thus, if a print command is specified, seven bits of character information defining, in a two's complement format, the absolute position number of a selected character on the daisy wheel print element 13 will be supplied on data lines $DL_0$–$DL_6$ while three bits of information defining the character width for ribbon advance purposes will be supplied on data lines $DL_7$–$DL_9$ and the hammer force with which printing is to be implemented is supplied as two bits of information on data lines $DL_{10}$ and $DL_{11}$.

Each daisy wheel employed in the exemplary print unit being discussed may include up to 96 spokes wherein each spoke has a character representation suitable for printing thereon. In actuality, in an English language system, only 88 of such spokes are utilized for character printing; however, the seven bit two's complement code supplied on data lines $DL_0$–$DL_6$ is more than sufficient to uniquely define each of such spokes with reference to a zero position on the wheel.

Similarly, to achieve high quality printing, the hammer impact level must vary in accordance with the nature of the character representation being printed. Thus, even in twelve pitch or ten pitch, if an *i* and an M character representation were printed with the same force, the M might be faintly represented while the same intensity applied to an *i* alphanumeric character representation might puncture the document being prepared. Therefore, as there are widely varying character representations in uniform pitch print modes and this mode of variation is compounded in proportional spaced printing, four levels of hammer force are employed for printing within the instant invention and supplied to the printer unit on data lines $DL_{10}$ and $DL_{11}$.

When a carriage movement command is supplied to the interface logic 305, a 12-bit word, which specifies the direction and number of printing spaces or columns through which the carriage is to be displaced (in multiples of an increment equal to 1/120th of an inch) is provided through data lines $DL_0$–$DL_{11}$.

Similarly, data representing a paper feed or indexing command is also applied as a 12-bit word to data lines $DL_0$–$DL_{11}$ under conditions wherein the information present on data lines $DL_0$–$DL_{10}$ represents the indexing displacement commanded while the data present on data line $DL_{11}$ represents the direction through which indexing is to occur. Thus, all data is directed to the printer on data lines $DL_0$–$DL_{11}$ to the interface logic indicated by the block 305 for further distribution to the various subsystems within the printer unit. More particularly, the interface logic indicated by the block 305 receives five input signals from the external control and supplies five output indications thereto. The input conductors present are annotated character strobe, carriage strobe, paper-feed strobe, ribbon action and restore. These input conductors serve to provide the printer unit with the following information:

Character or Print Wheel Strobe—A signal used to sample the print information provided on data lines $DL_0$–$DL_{11}$.

Carriage Strobe—A signal used to designate and cause sampling of a 12-bit carriage displacement command supplied on data lines $DL_0$–$DL_{11}$.

Paper-Feed Strobe—A signal used to designate and cause the sampling of a 12-bit paper-feed command presented on data lines $DL_0$–$DL_{11}$.

Ribbon Action—A signal employed to control the position of a matrix-type plastic ribbon between an up print position and a down position where the ribbon does not have a tendency to obscure the operator's view of the print location.

Restore—A signal employed to set the daisy wheel print element 13, the print element carriage 10 and the various logic registers to initial conditions, such as when a system is initially energized or reset.

Additionally, although only five control input conductors have been provided to the printer unit in the instant embodiment of the invention being described, it will be appreciated by those of ordinary skill in the art that additional inputs could be supplied if additional printer functions were desired. For instance, in a printer having the capability of employing a two or more color ribbon, a ribbon logic input could be supplied to designate the level to which the ribbon is raised to control the portion of the multicolor ribbon, which is impacted during printing.

The five status outputs provided by the printer unit are indicated in FIG. 5 as including the conductors annotated printer ready, character ready, carriage ready, paper-feed ready and end of ribbon. These conductors are utilized to perform the following functions:

Printer Ready—A conductor whose level is utilized to indicate that the printer is properly supplied with power.

Character Ready—A conductor whose signal level is utilized to indicate that the printer is in a ready condition to accept a character command.

Carriage Ready—A conductor whose signal level is utilized to indicate that the printer is ready to accept new carriage displacement commands.

Paper Feed Ready—A conductor whose signal level is relied upon to indicate that the printer is ready to accept new paper-feed commands.

End of Ribbon—A sensor initiated indication utilized to provide the operator with an indication that the end of ribbon is near.

Although only five status output conductors have been illustrated in FIG. 5, it will be appreciated that additional status conductors may be employed to monitor additional status conditions at the printer.

The print wheel logic circuitry indicated by the dashed block 306 controls all functions of the printer associated with the basic motion of displacing the daisy wheel print element so that a selected character is placed in a print position and printed. The print logic circuitry indicated by the dashed block 306 is connected to the interface logic 305 through the multiconductor cable 327 and comprises print logic means 333, print wheel logic means 334, print wheel servo means 335, ribbon level encoder means 337, hammer level encoder means 339 and driver means 340–342. The print logic means 333 is connected through the multiconductor cable 327 to the interface logic 305 and serves as a buffer and control means between information forwarded from the interface logic 305 to the reamining elements within the print logic circuitry indicated by the dashed block 306 to appropriately sequence the operation of the hammer level encoder means 339 with respect to the print wheel logic 334 and the ribbon level encoder means 337 and additionally serves to convey status information, in the form of a character ready input, to the interface logic 305 upon the appropriate completion of a character print operation to indicate that new character information may be supplied to the printer unit.

More particularly, focusing for the moment on actual data applied to the interface logic indicated by the block 305 on conductors $DL_0$–$DL_{11}$, the print logic means 333 functions with respect to data received on data lines $DL_0$–$DL_{11}$ to receive such data upon the arrival of a character strobe which identifies that data as appropriate for the print logic circuitry indicated by the dashed block 337 and divide the bits therein in an appropriate manner among the ribbon advance encoder means 307, the print wheel logic means 334 and the hammer level encoder means 339.

The print wheel logic means indicated by block 334 may be viewed as including a present position counter and a logic and difference counter for providing an indication of the difference in terms of both magnitude and direction between the seven-bit address supplied to the print wheel logic means 334 from data lines $DL_0$–$DL_6$ and the print wheel position indicated by the present position counter. Upon the occurrence of a character strobe at the control input to interface logic 305, the seven bit, two's complement code designating a particular character is supplied through the multiconductor cable 343 to the print wheel logic means 334 and more particularly is applied in parallel to the logic and difference counter which also receives a seven-bit output from the present position counter present within the print wheel logic 334. The present position counter present within the print wheel logic 334 is utilized to maintain a count indicative of the actual position of the daisy wheel print element due to previous rotations therein in previous printing cycles. Thus, assuming a 96-character print wheel, the absolute print wheel address will designate the rotation coordinates of the character to be printed with respect to a home position while the present position counter will provide an output signal designating the present coordinates of the print wheel.

These two outputs are applied to the logic and difference counter where they are subtracted and an output indicating the shortest rotational movement to place the print wheel in a position where the desired character resides, as specified by the seven-bit word presented on data lines $DL_0$–$DL_6$ is provided at the output thereof. As will be readily appreciated by those of ordinary skill in the art, the shortest rotational distance to achieve appropriate daisy wheel print element positioning may be obtained by taking both the difference and complemented difference between the inputs of the present position character and the characters supplied on data lines $DL_0$–$DL_6$. Thereafter, the smallest value between the actual difference count and the complemented count is selected to represent the magnitude of the displacement where the actual difference is utilized to represent rotation of the print wheel in one direction, i.e., clockwise, and the complemented difference is utilized to indicate rotational movement in the opposite direction. Thus, the logic and difference counter provides a pair of output signals wherein one such signal is indicative of the magnitude of the rotation through which the print wheel is to be driven while the other such output is indicative of the direction in which rotation is to occur. Furthermore, as the present position counter is continuously incremented as the daisy wheel print element 13 is rotated, it will be appreciated by those of ordinary skill in the art that the magnitude of the output from the logic and difference counter will continuously diminish as the daisy wheel print element is rotated toward a defined position. Due to the manner in which the print wheel logic initially specifies the direction and magnitude of the displacement through which the daisy wheel print element is to be rotated and thereafter provides a continuously diminishing signal representing the remaining necessary displacement, the output of the print wheel logic may be utilized to initiate and control the displacement of the print wheel driver as well as providing for an operation completed signal and other necessary housekeeping signals when the designated print position is obtained. For these reasons, the output of the print wheel logic means 334 as well will be more fully appreciated upon a review of U.S. Pat. No. 3,858,509 and may be used to develop a velocity signal indicating various velocities for large displacements and a level control signal for precisely centering the print wheel at a desired location. These signals are applied through multiconductor cable 346 to the print wheel servo which responds thereto to actually displace the daisy wheel print element in accordance with the velocity and control signals supplied and acts to update the position information maintained within the present position counter of the print wheel logic means 334 as the displacement occurs. As will be appreciated by those of ordinary skill in the art, when the output of the logic and difference counter present within the print wheel logic means 334 becomes zero, indicating that the daisy wheel print element has been rotated to the defined print position, this zero level may be applied through conductor 343 to the print logic means 333 to indicate that the print wheel displacement operation has been successfully completed and may be employed as an input to an AND gate for developing the triggering level for the hammer firing signal.

The output of the print wheel servo means 335 is connected through a conductor 347 to the print wheel driver means 341. The print wheel driver means 341 may take the form of a conventional motor driver circuit which responds to the magnitude and polarity of an input signal applied thereto to cause motor 23 to rotate a shaft in a direction indicated by the polarity of the input and at an instantaneous velocity representative of the magnitude of such input. Thus, the print wheel logic means 334, the print wheel servo means 335 and the print wheel driver means 341 act in conjoint to appropriately position a daisy wheel print element 13 at a position so that the character defined by the seven-bit code supplied on conductors $DL_0$–$DL_6$ during a print command is placed in an appropriate position for impacting by a hammer and hence printing.

The ribbon advance encoder means 337 receives, as aforesaid, the three-bit word from the multiconductor cable 344 which defines the character width as originally specified on data lines $DL_7$–$DL_9$ by the character information specified thereon during a print instruction. Thus, depending upon the input levels supplied to the ribbon advance encoder means 337, an output indicating the amount the ribbon is to be displaced is applied to the multiconductor cable 348 connected to the ribbon motor driver means 342. The ribbon motor driver means 342 may take the form of a conventional amplifier or driver apparatus which acts in the well-known manner to apply the level encoder output of the ribbon advance encoder means 337 to a stepper motor means after raising the same to a suitable magnitude to drive the stepper motor. Upon the completion of the incrementing of the ribbon by the ribbon stepping motor, a signal is supplied from the ribbon level encoder means 337 through the multiconductor cable 344 to the printer logic means 333. At any rate, the print logic means 333 receives an indication from both the ribbon displacement circuitry indicated by the blocks 337 and 342 and a print wheel displacement completed indication from the circuitry indicated by the blocks 334 and 335 indicative that the functions of print wheel displacement and ribbon incrementing for a given character have been completed thereby. Both of these function-completed signals are ANDed at the print logic means 333 and employed to develop a hammer fire signal as aforesaid.

The two-bit word initially supplied for each character on data lines $DL_{10}$ and $DL_{11}$ associated with the hammer force with which a given character is to be printed are supplied from the print logic means 333 through the multiconductor cable 345 to the hammer level encoder means 339. The output of hammer level encoder means 339 is applied through the multiconductor cable 349 to the hammer coil driver means 340. The actual application of the output of the hammer coil driver 340 to the slenoid does not occur until a triggering level is supplied to the hammer coil driver means 340 through multiconductor cables 345 and 349 from the print logic means 333. This triggering level is provided as a function of the print wheel positioning and ribbon displacement completed signals provided thereto so that the triggering of the hammer does not occur until the daisy wheel print element has been appropriately positioned to the desired character location and the ribbon incremented to assure appropriate printing will take place.

After the expiration of a suitable interval following the inssuance of a hammer trigger signal by the print logic means 333, signal is applied through the multiconductor cable 327 which causes the interface logic means 305 to provide a character ready status output on the appropriate conductor for application to the external control means. Thus, it will be appreciated that when a three-word character associated with character printing is applied to data lines $DL_0$–$DL_{11}$ and a character strobe is applied to the interface logic indicated by the block 305, the print logic circuitry indicated by the dashed block 306 responds to each of the words therein to cause printing of the character to occur.

The carriage logic means 317, the carriage servo means 318 and a carriage motor driver 351 together with the carriage motor connected thereto may each take the same form as the corresponding elements associated with the daisy wheel print element. More particularly, as the carriage logic means 317 receives a 12-bit input wherein the high order bit designates the direction in which travel is to occur, i.e., right or left, while the lower 11 order bits designate the distance to be travelled in increments of 1/120th of an inch.

The paper-feed logic means 321, like the carriage logic means 317, accepts a 12-bit movement command which in this case represents the upward or downward indexing of the paper. The high order bit supplied on data line $DL_{11}$ represents the direction in which movement is to take place while the data character presented on data lines $DL_{10}$–$DL_0$ represents the displacement to be implemented in increments of 1/48th of an inch or 1/8th of a print line advance.

The ribbon lift logic 323 here performs the function of positioning a black or other signle color matrix-type plastic ribbon in a first position intermediate the character slug of the daisy wheel print element 13 and the document to be printed so the same is impacted when the print hammer strikes the selected character slug of the daisy wheel print element or a second position in which the ribbon is in a down position and hence does not tend to obscure the operator's view of the print position on the document being printed. When the ribbon action input conductor to the interface logic 305 is high, the ribbon is placed in the down position while, when the input on the ribbon action is low, the ribbon is placed in a first or up position. For this reason, the ribbon lift logic means 323 need only comprise a flip-flop or other suitable logic device which produces an output which follows the input supplied thereto. The input to the ribbon lift logic 323 is supplied through a cable 330 from the interface logic block 305, which essentially acts to apply the level on the ribbon action input thereto, to the ribbon lift logic 323 although the internal structure of the interface logic 305 may be employed to raise the control signal on the ribbon action conductor to an appropriate output level for the ribbon lift logic 323. The output of the ribbon lift logic 323 is applied through a conductor 357 to ribbon lift driver means 358. The ribbon lift driver means 358 may comprise any suitable form of driver stage which raises the output of the ribbon lift logic means 358 to a level which is suitable to drive the ribbon lift coil indicated. The output of the ribbon lift driver 358 is connected, as indicated in FIG. 5, to the ribbon lift coil through a conductor 359. Therefore, as will be appreciated by those of ordinary skill in the art, when a low condition resides on the conductor annotated Ribbon Action, this low level will be reflected at the output of the ribbon lift logic means 323 and conveyed to the ribbon lift coil to place the ribbon in an up condition which is the appropriate condition for a printing operation. However, when the level on the ribbon action input conductor goes high, indicating that no character input has been provided within a specified interval, this high level is reflected at the output of the ribbon lift logic means 323 whereupon the ribbon lift coil is de-energized and the ribbon is displaced in its nonprint or low condition so that the operator may clearly view the portion of the document at which printing is to occur.

The end of ribbon sensor means 326 is employed within the instant invention to apprise the operator and hence the system as a whole that the carbon ribbon employed in the printer unit for print purposes is approaching exhaustion and upon exhaustion, to shut down the system.

The restore input conductor provides a specialized input to the printer unit which causes the printer unit to be placed in a predetermined initial state. More particularly, an input on the restore input conductor causes a restore operation sequence to occur at the printer unit wherein the printer unit is placed in an initial condition by returning the carriage to the first character position, rotating the daisy wheel print element to its starting or home position and resetting the internal logic of the printer unit. The restore sequence is introduced to the logic whenever power is turned on or when an operator activates the restore command input line through a reset operation or the like. In addition, during the restore sequence, the ribbon lift logic means 323 may be gated to place the ribbon in its down position while paper-feed logic means 321 is inhibited. Accordingly, as will be appreciated by those of ordinary skill in the art, the restore operation initiated by a restore input establishes a set of initial conditions in the printer unit so that from this point forward, synchronization between the various monitoring registers in the printer unit and the various command displacements issued to the printer will be assured.

In summary, the sequence of operation for printing a character is: (1) the ribbon is signaled to be lifted to the print position, (2) the ribbon is advanced to place fresh ribbon at the print position, (3) the print wheel is rotated in the direction requiring the least amount of travel to position the correct character slug at the print position in front of the hammer, (4) the print wheel is then stopped, (5) the hammer is fired at the correct intensity level for the character to be printed, (6) the carriage is moved to be positioned to the correct horizontal position for the printing of the next character and (7) the paper is fed to the correct vertical position if required. Remember, this printing occurs at up to 30 times per second. Needless to say, paper must be loaded into the printer initially and positioned correctly prior to the start of printing a document. If the printing of characters ceases for a time greater than a specified interval, then the ribbon is placed in the down position and the print wheel is rotated to the home or view slot position so the operator may view the previously printed material.

Figure 6:
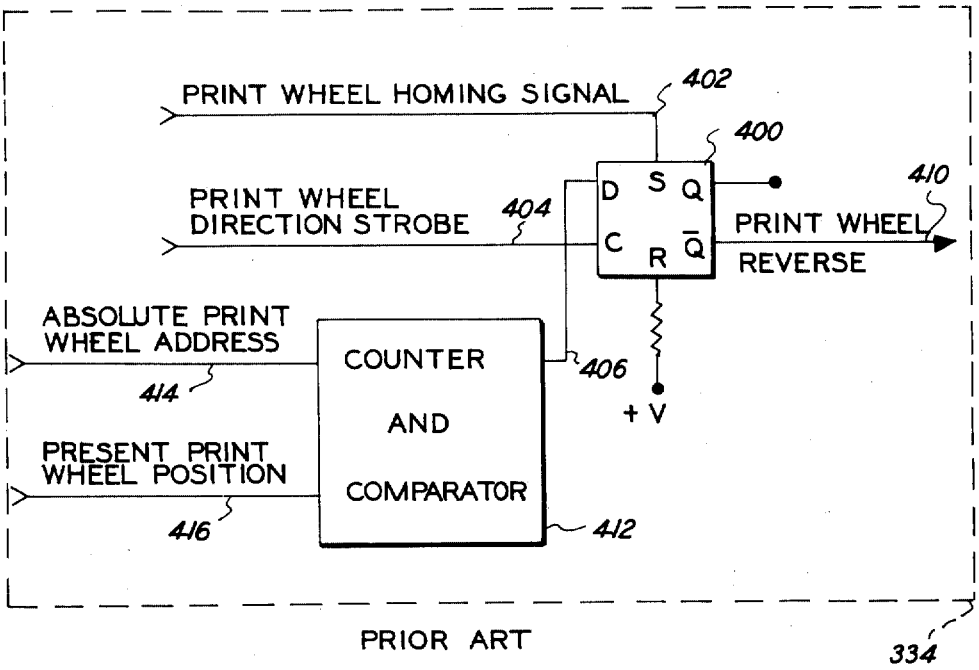
FIG. 6 is a simplified schematic view of the prior art for controlling the direction of print wheel rotation.

Referring now to FIG. 6, which depicts only a small but pertinent portion of the overall print wheel logic 334 of FIG. 5, there is shown the prior art of the print wheel direction function. Flip-flop 400 is preferably a 7474 integrated circuit (a dual, D-type, edge-triggered flip-flop), only a portion of which is used for the present function. One input to flip-flop 400 is the print wheel homing signal applied through line 402 and is the initializing signal for the flip-flop. Further inputs include the print wheel direction strobe applied through line 404 and the difference indication from the counter and comparator 412 applied on line 406. The output of flip-flop 400 is provided on line 410 as the print wheel reverse signal.

The counter and comparator 412 has, among other inputs, two inputs pertinent to the present invention. These two inputs are (1) the absolute print wheel address applied on line 414 and (2) the present print wheel position applied on line 416. Since there are 96 rotation coordinates designated around the print wheel, because of the 96-character print wheel used in the original Diablo design, the absolute print wheel address will designate the rotation coordinates of the character to be printed with respect to a home position. The present print wheel position input on line 416 provides a designation of the present rotation coordinates of the print wheel with respect to the home position. Among the various calculations performed by and the outputs of the counter and comparator 412, the one output of present interest is applied on line 406. The output on line 406 is an indication of the determination by the counter and comparator 412 of the amount of rotation in a clockwise (cw) direction as viewed by the operator, which is required to move the print wheel from its present position to the next desired position. If the amount of rotation required is 180° or more (48 character or spoke positions or more) the difference indication signal on line 406 will be set to a low (0) logic level. If the amount of rotation required in the cw direction is less than 180° (less than 48 characters or spoke positions), the difference indication signal on line 406 will be set to a high (1) logic level.

When the printer is initially energized, the print wheel homing signal on line 402 is pulsed to a low (0) logic level resulting in the print wheel reverse signal, on line 410 from flip-flop 400, being set to the low (0) logic level. For this system, the low (0) logic level on line 410 preferably causes the print wheel to rotate clockwise (cw) as viewed by the operator and at this time, the print wheel will rotate clockwise (cw) to its home position and remain until print wheel displacement data is received by the printer.

Upon the occurrence of print wheel displacement data on data lines $DL_0$–$DL_6$, applied to the interface logic 305 of FIG. 5 and subsequently applied to the print wheel logic 334, either a low or high logic level will be set on line 406. Another of the outputs (but not shown) of the counter and comparator 412 is the magnitude of the rotation which is determined as set forth supra. After the magnitude of the rotation of the print wheel has been determined and the proper logic level has been set on line 406 and just prior to beginning the movement of the print wheel, the print wheel direction strobe on line 404 is pulsed to a high (1) logic level. This high (1) logic level pulse on line 404 essentially transfers the logic level at that time on line 406 to Q in the flip-flop 400 and the inverse to $\overline{Q}$ in flip-flop 400. In other words, if there is a high logic level on line 406 when line 404 is pulsed to a high logic level, output line 410 will remain at the low logic level. If there is a low logic level on line 406 when line 404 is pulsed to a high logic level, output line 410 will be set to a high (1) logic level which will reverse the direction of print wheel rotation and cause it to go in a counterclockwise (ccw) direction. This same sequence of events resulting in the determination of the proper direction of rotation of the print wheel will occur for each character to be printed with the print wheel rotating the shortest distance (cw or ccw) to the next character. It will be appreciated that this determination of direction of rotation is independent of the ribbon lift function. The print wheel may be commanded to rotate either cw or ccw while the ribbon is being lifted up to the print position. If the print wheel is rotated in a particular direction when the ribbon is being lifted up to the print position, the character slugs will be moving downwardly and if the curled edge or edges of the ribbon contact the character slugs, the ribbon could be prevented from lifting or completely lifting up to the print position.

As will be readily appreciated by those of ordinary skill in the art, the shortest rotational distance to achieve appropriate daisy wheel print element positioning is preferable in order to assist in the achieving of the highest printing speed possible. Even though, the daisy wheel print element is sometimes rotated the longer distance when always rotated in the cw direction when the ribbon is initially lifted to the up or print position, no impact on total through-put printing speed is noted.

In the particular printer embodiment of FIG. 1, the ribbon 24 moves (as viewed by the operator) from the right side of ribbon cartridge 16 to the left side of the ribbon cartridge. The fresh ribbon 24 exists from the right extension of the ribbon cartridge 16 and moves left to the print position opposite the printing mechanism 48 where the printing occurs. The used ribbon 24, in a cupped condition, moves left from the print position and enters the left extension of the ribbon cartridge 16. If the character slugs 2 of the print wheel 13 contact the edge or edges of the cupped ribbon 24 while rotating ccw (as viewed by the operator), the character slugs will force the ribbon in a downwardly direction and retard the lifting of the ribbon to the print position. If the character slugs 2 of the print wheel contact the edge or edges of the cupped ribbon 24 while rotating cw (as viewed by the operator), the character slugs will force the ribbon in an upwardly direction and enhance the lifting of the ribbon to the print position. If in the particular printer embodiment, the ribbon moved from left to right, then the effect noted above by the rotation of the print wheel would be reversed.

Figure 7:
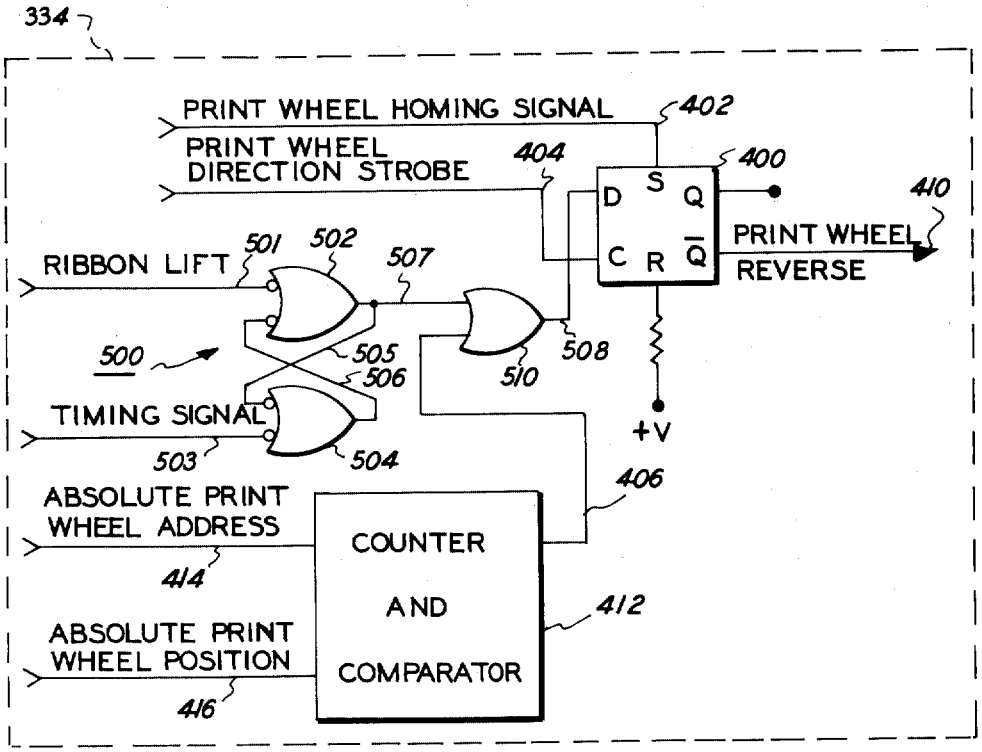
FIG. 7 is a simplified schematic view of the present invention for controlling the direction of print wheel rotation.

With reference to FIG. 7, one embodiment of the present invention provides means and methods for enhancing ribbon lift and preferably comprises a cross-coupled latch circuit 500 in conjunction with an OR gate 510. The cross-coupled latch circuit 500 is preferably comprised of a 7400 integrated circuit (a quadruple two-input positive NAND gate), only a portion of which is used for the present function. The output of gate 502 is provided on line 507 as one input to OR gate 510 and on line 505 as one input to gate 504. The other input on line 503 to gate 504 is a timing signal derived from the character or print wheel strobe. The output of gate 504 is provided on line 506 as one input to gate 502. The other input on line 501 to gate 502 is the ribbon lift signal. The output of the counter and comparator 412 is provided on line 406 as the other input to OR gate 510. The output of OR gate 510 is provided on line 508 as the input to the D terminal on flip-flop 400. The other inputs and outputs of flip-flop 400 remain the same as in the prior art of FIG. 6.

With reference to FIG. 7, when the printer is initially energized, the print wheel homing signal on line 402 is pulsed to a low (0) logic level resulting in the print wheel reverse signal, on line 410 from flip-flop 400, being set to the low (0) logic level. For this system, the low logic level on line 410 preferably causes the print wheel to rotate clockwise (cw) as viewed by the operator and at this time, the print wheel will rotate clockwise (cw) to its home position and remain until print wheel displacement data is received by the printer. At this time, the ribbon lift signal on line 501 is set at the low (0) logic level because the ribbon is in the down position. The low logic level on line 501 sets a high (1) logic level on line 507 which results in a high (1) logic level being set on line 508. The high logic level on line 507 results in a high logic level on line 505 which results in a low logic level on line 506. The timing signal on line 503 is normally set at the high logic level and is pulsed to the low logic level after the completion of each print cycle. A low logic level on either of the two input lines 501 or 506 of gate 502 will result in a high logic level on output line 507. Also, a low logic level on either of the two input lines 503 or 505 of gate 504 will result in a high logic level on output line 506.

Now, upon the occurrence of print wheel displacement data applied to print wheel logic 334, the output of the counter and comparator 412 on output line 406 (whether it be at a high or low logic level) will not affect the print wheel reverse signal on line 410. This is because line 507, one input to OR gate 510, is at the high logic level and therefore the output on line 508 will remain at the high logic level. With line 508 at the high logic level, the print wheel reverse signal on line 410 will remain at the low logic level and the print wheel will rotate cw to position the print wheel even though that direction of rotation may not be the shortest path. Also, at this time the ribbon lift signal on line 501 is set to the high logic level but this does not affect the logic level on line 507 because the other input to gate 502 is at the low logic level. It will be appreciated that the present invention forces the print wheel to always rotate cw when the ribbon is initially lifted.

After the printing of the first character, the timing signal on line 503 is pulsed to the low logic level. This low logic level on line 503 results in a high logic level being set on line 506 which, in turn, results in a low (0) logic level being set on line 507 and line 505. This set of conditions results in the cross-coupled latch circuit 500 being "latched" such that the change of logic level of the timing signal on line 503 has no effect on the logic level on output line 507. The logic level on output line 507 will remain at the low (0) logic level as long as the ribbon is in the up or print position causing a high logic level on line 501. With the logic level on line 507 at the low logic level, the logic level on line 508 will follow the logic level on line 406 from the counter and comparator 412, and the print wheel will again rotate, for each character to be printed, the shortest distance (cw or ccw) to the next character. This type of action will continue until printing ceases and then the print wheel will rotate and stop at the home position and the ribbon will drop. Then when the ribbon is raised to the up or print position, as previously explained supra, the print wheel will be rotated cw to the desired position irregardless of whether cw is the shortest path direction or not.

It will be appreciated that there has been shown an illustrative arrangement for use in a print wheel impact printer to provide for the enhancement of ribbon lift that fully satisfies the objects, aims and advantages set forth above. While the principles of the invention have been made clear in the illustrative embodiment, it is apparent that alternatives, modifications and variations will be evident to those skilled in the art. Accordingly, it is intended to embrace all alternatives, modifications and variations as fall within the spirit and broad scope of the appended claims.

What is claimed is:

1. In a printer having a printing mechanism including a daisy wheel print element which is rotatable in one direction and then in the opposite direction, a ribbon supply means, a ribbon feed means for feeding an ink ribbon past the print element at a print station and a ribbon lift means for positioning the ribbon between a first position and then a second position; the improvement comprising:

first logic means having an output and a plurality of inputs, said output indicating the direction the print element is to be rotated past the print station for the printing of the characters, second logic means having an output and a plurality of inputs and including means to maintain said output in a first condition in response to an input indicating a signal has been provided to cause the ribbon to be moved from the first position to the second position, third logic means coupled between the first logic means and the second logic means and having an output and a plurality of inputs, one input indicating the distance the print element must be rotated from the character previously printed to the next character to be printed, said output being in a first condition, whereby said print element is rotated in a first direction past the print station for the printing of the first character, said first direction being opposite to the direction of linear movement of the ribbon past the print station, means for changing said output of said second logic means from said first condition to a second condition prior to the printing of the next character, means to maintain said output of said second logic means in said second condition during the printing of subsequent characters during the continuance of the ribbon being held in the second position, whereby said print element is rotated in the direction providing the least amount of rotation from the character previously printed to the next character to be printed, and means for changing said output of said second logic means from said second condition to said first condition in response to an input indicating a signal has been provided to cause the ribbon to be moved from the second position to the first position.

2. The improvement of claim 1 wherein said first logic means comprises a flip-flop means.

3. The improvement of claim 1 wherein said second logic means comprises a latching means.

4. The improvement of claim 1 wherein said third logic means comprises a gating means.

5. A method for reducing the effect of any interference between a print element and a ribbon in a printer during ribbon lift, said method comprising the steps of:

initiating ribbon lift to position the ribbon from a first position to a second position, providing for linear movement of the ribbon in one direction past a print station, initiating rotation of the print element past the print station in a first direction in preparation for printing a first character subsequent to each initiation of ribbon lift, said first direction being opposite to the direction of linear movement of the ribbon past the print station even if said first direction requires a rotation of greater than 180° to move said first character to said print station; and initiating rotation of the print element past the print station in a direction providing the least amount of rotation from the character previously printed to the next character to be printed, while the ribbon remains in the second position.

* * * * *